US009677317B2

(12) United States Patent
Daniel-Wayman et al.

(10) Patent No.: US 9,677,317 B2
(45) Date of Patent: Jun. 13, 2017

(54) VARIABLE SPEED MOVABLE BARRIER OPERATOR

(75) Inventors: Robert Daniel-Wayman, Lombard, IL (US); Brian F. Butler, Chicago, IL (US); Patrick B. Evans, Elmhurst, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 1652 days.

(21) Appl. No.: 12/396,922

(22) Filed: Mar. 3, 2009

(65) Prior Publication Data

US 2010/0223853 A1 Sep. 9, 2010

(51) Int. Cl.
*E05F 15/616* (2015.01)

(52) U.S. Cl.
CPC ..... *E05F 15/616* (2015.01); *E05Y 2400/514* (2013.01)

(58) Field of Classification Search
CPC ..... E05F 15/616; E05Y 2400/514
USPC ..... 49/339, 340, 344, 345
See application file for complete search history.

(56) References Cited

U.S. PATENT DOCUMENTS

| | | | | |
|---|---|---|---|---|
| 216,777 | A | 6/1879 | Barry | |
| 1,350,134 | A | 8/1920 | Bellican | |
| 1,492,257 | A | 4/1924 | Moore | |
| 1,578,780 | A | 3/1926 | Titus | |
| 1,645,977 | A | 10/1927 | Titus | |
| 1,903,923 | A | 4/1933 | Hyde | |
| 2,563,894 | A | 8/1951 | White | |
| 3,287,757 | A | 11/1966 | Noord | |
| 3,572,223 | A | 3/1971 | Vierregger | |
| 4,367,610 | A * | 1/1983 | Goode | 49/336 |
| 4,430,638 | A | 2/1984 | Parker | |
| 4,489,306 | A | 12/1984 | Scolari | |
| 4,531,325 | A | 7/1985 | Phillips | |
| 4,870,543 | A | 9/1989 | Born et al. | |

(Continued)

FOREIGN PATENT DOCUMENTS

| | | |
|---|---|---|
| EP | 0443052 | 2/1990 |
| FR | 2586745 | 3/1987 |

OTHER PUBLICATIONS

LiftMaster Professional Addendum to LA400 Owner's Manual, 2006, 2 pages.

(Continued)

*Primary Examiner* — Gregory Strimbu
(74) *Attorney, Agent, or Firm* — Fitch Even Tabin & Flannery LLP

(57) ABSTRACT

A movable barrier system allows for varying the linear actuator speed to account for speed variances caused by the physical configuration of the system. An example system includes a processor configured to variably control operation speed of the linear actuator when it moves a movable barrier between a first position of the movable barrier and a second position of the movable barrier as a function of location of the movable barrier pivot connection relative to the linear actuator pivot connection. The function may be a function of a ratio of a distance from the linear actuator pivot connection to a fixed point and a distance from the movable barrier pivot connection to the fixed point. The function may be calculated by the processor or accessed by the processor according to information about the physical configuration of the system.

19 Claims, 4 Drawing Sheets

(56) References Cited

U.S. PATENT DOCUMENTS

| | | | | |
|---|---|---|---|---|
| 4,893,119 | A | 1/1990 | Nasatka | |
| 4,934,203 | A * | 6/1990 | Bailey et al. | 74/89.35 |
| 5,035,082 | A | 7/1991 | Butler | |
| 5,133,152 | A | 7/1992 | Grancagnolo | |
| 5,136,813 | A | 8/1992 | Gibbs et al. | |
| 5,373,664 | A | 12/1994 | Butler | |
| 5,394,651 | A * | 3/1995 | Vial | 49/394 |
| 5,499,887 | A | 3/1996 | Verra | |
| 5,500,642 | A | 3/1996 | Battle | |
| 5,804,938 | A * | 9/1998 | Richmond et al. | 318/282 |
| 5,829,913 | A | 11/1998 | Puckett | |
| 5,869,940 | A | 2/1999 | Parsadayan | |
| 6,364,374 | B1 | 4/2002 | Noone et al. | |
| 6,487,818 | B1 | 12/2002 | Hamann et al. | |
| 6,650,076 | B1 | 11/2003 | Hom et al. | |
| 6,712,547 | B1 | 3/2004 | Shauf, Sr. et al. | |
| 6,742,303 | B2 * | 6/2004 | Pedemonte | 49/339 |
| 6,883,275 | B2 * | 4/2005 | Hellinga et al. | 49/345 |
| 6,935,000 | B1 * | 8/2005 | Arnaud | 16/239 |
| 7,000,355 | B2 | 2/2006 | Flory et al. | |
| 7,107,722 | B2 * | 9/2006 | Casali et al. | 49/341 |
| 7,146,766 | B2 | 12/2006 | Finkelstein | |
| 7,287,929 | B1 | 10/2007 | Sokolowski et al. | |
| 7,367,161 | B1 | 5/2008 | Jones | |
| 7,472,891 | B2 | 1/2009 | Schram et al. | |
| 7,958,675 | B2 | 6/2011 | Stull | |
| 2001/0037600 | A1 * | 11/2001 | Hormann | 49/31 |
| 2003/0015980 | A1 * | 1/2003 | Richmond et al. | 318/280 |
| 2004/0145332 | A1 | 7/2004 | Hom et al. | |
| 2004/0177558 | A1 * | 9/2004 | Parsadayan et al. | 49/340 |
| 2007/0075655 | A1 * | 4/2007 | VanDrunen et al. | 318/66 |
| 2007/0221904 | A1 | 9/2007 | Stull | |
| 2010/0139170 | A1 | 6/2010 | Planck et al. | |
| 2010/0139188 | A1 | 6/2010 | Callentine | |
| 2010/0223853 | A1 | 9/2010 | Daniel-Wayman et al. | |

OTHER PUBLICATIONS

LiftMaster Professional Owner's Manual Model LA400, 2007, 32 pages.

* cited by examiner

VARIABLE SPEED MOVABLE BARRIER OPERATOR

TECHNICAL FIELD

This invention relates generally to movable barrier operators and more specifically to movable barrier operators using linear actuators.

BACKGROUND

Various types of movable barrier operators are known. One such type of movable barrier operator is a swinging gate, which swings either horizontally or vertically (known for example as a California door), that is operated using a linear actuator. The linear actuator operates by extending and contracting its length, sometimes via an extending/retracting arm, to move the barrier. The movable barrier for such operators pivot about a pivot point during movement. As the linear actuator creates a rotational movement of the movable barrier when the linear actuator extends or contracts, and the linear actuator pivots about its own second pivot point during operation. The linear actuator or its extending/retracting arm is connected pivotally to the movable barrier to exert a force on and to move the barrier. The fixed pivot points for the movable barrier and the linear actuator each have a fixed distance to a third fixed point. Typically, this third fixed point is at a perpendicular intersection of lines drawn through the fixed pivot point for the movable barrier operator and the fixed pivot point for the linear actuator and may be, for example, a post supporting the movable barrier operator and barrier.

Often, the linear actuator operates at primarily a constant speed. If the ratio of the distance between the movable barrier pivot point to the fixed point and the linear actuator pivot point to the fixed point is about 1:1, the movable barrier moves at about a constant speed. The movable barrier speed, however, can vary over its travel distance when this ratio is not about 1:1. For example, physical restraints in setting up the movable barrier system can result in these ratios varying significantly from 1:1 ratio thereby causing significant speed variations in the barrier movement over its travel distance. For instance, if the linear actuator operates at a constant speed, the movable barrier's speed may vary from a faster speed at a closed position to a slower speed at an open position based on the system's physical arrangement. Accordingly, these varying barrier speeds when moving from a first position to a second position, such as moving from an open position to a closed position or vice versa, can result in a widely varying user perception of the operation of the system. For instance, movement of the movable barrier may be considered by the user to be too slow during certain portions of the barrier's travel.

SUMMARY

Generally speaking, and pursuant to these various embodiments, an example movable barrier system allows for varying the linear actuator speed to account for speed variances caused by the physical configuration of the system. One such system includes a movable barrier pivotally connected to a movable barrier pivot connection. The system also includes a linear actuator with a first end pivotally connected to the movable barrier and a second end pivotally connected to a linear actuator pivot connection. A processor is configured to variably control operation speed of the linear actuator during operation between a first position of the movable barrier and a second position of the movable barrier as a function of location of the movable barrier pivot connection relative to the linear actuator pivot connection. The first and second positions may be end of travel positions such as a closed position and an open position. By one approach, the function by which the processor variably controls the operation speed of the linear actuator comprises a function of a ratio of a distance from the linear actuator pivot connection to a fixed point and a distance from the movable barrier pivot connection to the fixed point. The function may then include operating the linear actuator at an increased speed when the movable barrier is near the first position when the distance from the movable barrier pivot connection to the fixed point is greater than the distance from the linear actuator pivot connection to the fixed point. By another approach, the function includes operating the linear actuator at a decreased speed when the movable barrier is near the first position when the distance from the movable barrier pivot connection to the fixed point is less than the distance from the linear actuator pivot connection to the fixed point. By yet another approach, the processor is configured to control actuation speed of the linear actuator during operation between a first position of the movable barrier and a second position of the movable barrier as to effect essentially constant movable barrier speed throughout a substantial portion of operation between the first position and the second position.

By still another approach, the function of position of the movable barrier pivot connection relative to the linear actuator pivot connection comprises a function of distance of the movable barrier relative to at least one of the first position and the second position. In this approach, the function of distance comprises operating the linear actuator at an increased speed when the movable barrier is closer to the first position than the second position when a distance from the movable barrier pivot connection to a fixed point is greater than a distance from the linear actuator pivot connection to the fixed point. Similarly, the function of distance may include operating the linear actuator at an increased speed when the movable barrier is closer to the second position than the first position when a distance from the movable barrier pivot connection to a fixed point is less than the distance from the linear actuator pivot connection to a fixed point.

In yet another approach, the function of position of the movable barrier pivot connection relative to the linear actuator pivot connection includes a piece-wise function comprising segments of speed change over distance between the first position and the second position wherein the speed change over distance depends at least in part on the function of position of the movable barrier pivot connection relative to the linear actuator pivot connection. In this example, the function allows for varying the linear actuator speed over the distance of travel between the first position and the second position such that the operation speeds may be tailored to a given system to account for variations caused by the system's physical configuration.

In still another approach, the movable barrier system includes a memory in communication with the processor, wherein the memory stores the linear actuator's speed values for operation between the first position and the second position. The linear actuator speed values in such an approach are based at least in part on the function of position of the movable barrier pivot connection relative to the linear actuators pivot connection. As an example, the system may have a number of sections of the memory wherein the sections contain different speeds of operation for the linear actuator according to the distance of the movable barrier from the first position or the second position to account for speed variations in the system.

One method of operating a movable barrier system with a linear actuator includes operating the movable barrier system as described above. By one approach, a method of operating a movable barrier system having a movable barrier pivotably connected to a movable barrier pivot connection and a linear actuator connected to a linear actuator pivot connection includes accepting information regarding relative positioning of the linear actuator pivot connection and the movable barrier pivot connection and operating the linear actuator to move between a first position and a second position according to a function of the relative positioning of the linear actuator pivot connection and the movable barrier pivot connection.

By one such approach, a method of operating a movable barrier system as described above includes operating the linear actuator to move the movable barrier between the first position and the second position as to effect essentially constant movable barrier speed throughout a substantial portion of operation between the first position and the second position. In one approach, a method of operating a movable barrier system as described above includes operating the linear actuator at an increased speed over a first distance of operation of the movable barrier between the first position and the second position. The first distance comprises a range over which the movable barrier operates at a reduced speed relative to a second distance of operation when the linear actuator operates at a substantially constant speed over the first and second distances. The first distance of operation of the movable barrier between the first position and the second position may be determined at least in part according to a function of the ratio of the distance from the linear actuator pivot connection to a fixed point and a distance from the movable barrier pivot connection to the fixed point.

So configured, the movable barrier system can vary the speed of the linear actuator to account for speed changes caused by the physical configuration of the movable barrier and the linear actuator. For instance, if the linear actuator has a fixed pivot point such that the gate swings with a relatively slow speed near the closed position, the movable barrier system can operate to accelerate the movement of the linear actuator to a higher speed to operate at relatively higher speed when the movable barrier is closer to the closed position as compared to when the movable barrier is closer to the open position. The movable barrier system therefore can achieve a more uniform speed of operation between the open and closed positions.

BRIEF DESCRIPTION OF THE DRAWINGS

The above needs are at least partially met through provision of the variable speed movable barrier operator and method described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION OF THE PREFERRED EMBODIMENT(S)

Figure 1:
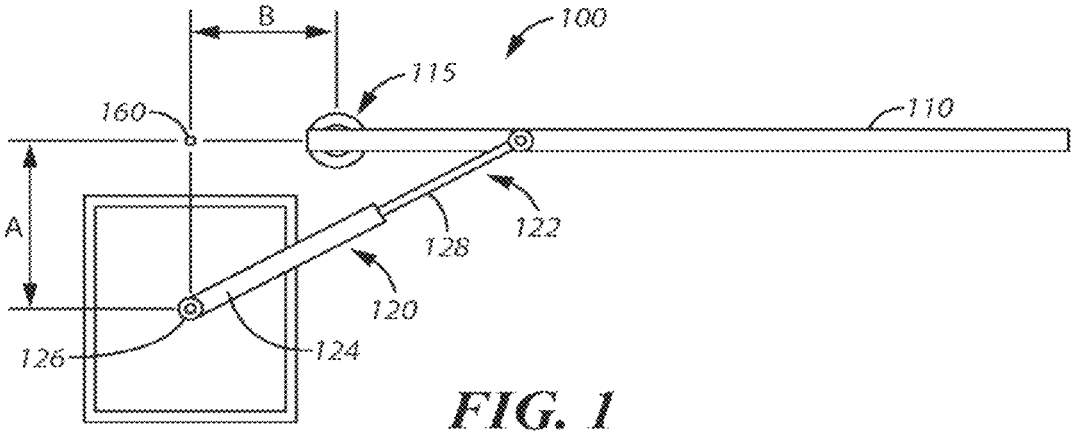
FIG. 1 comprises a top plan view of a movable barrier system as configured in accordance with various embodiments of the invention.
Figure 2:
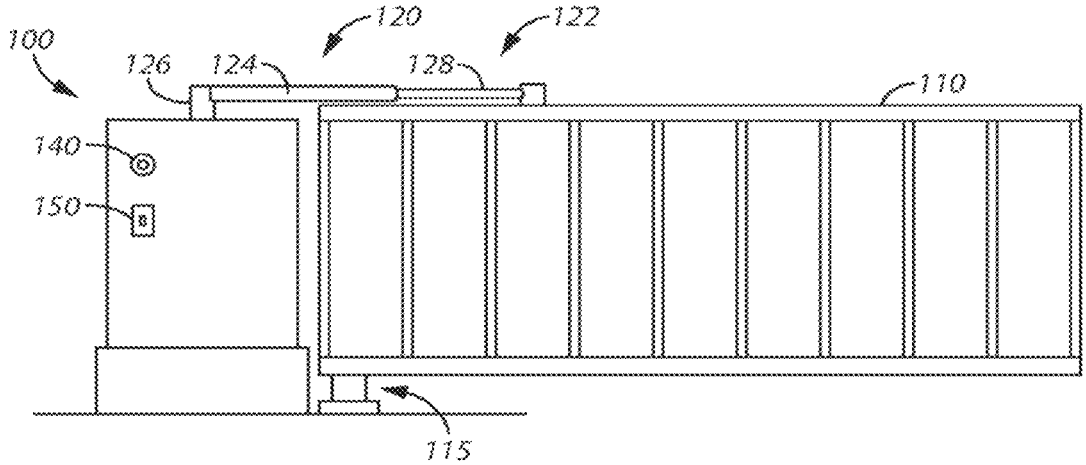
FIG. 2 comprises a side view of a movable barrier system as configured in accordance with various embodiments of the invention.
Figure 3:
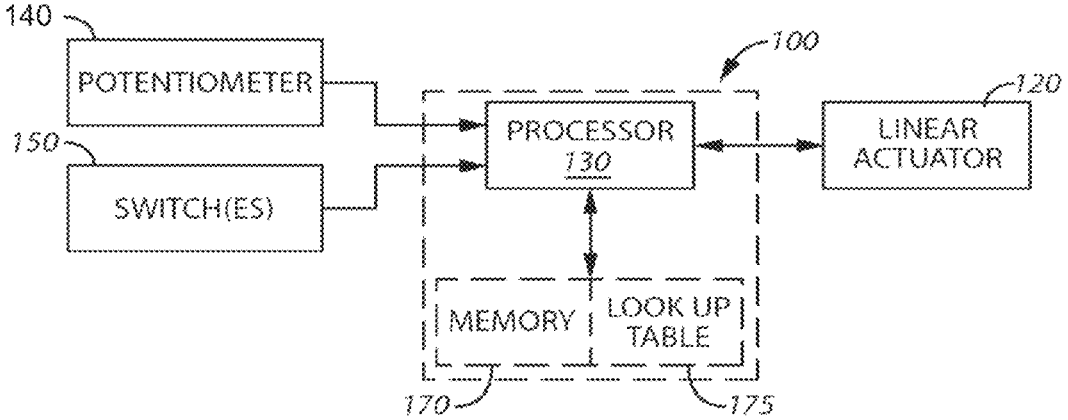
FIG. 3 comprises a block diagram of a movable barrier system as configured in accordance with various embodiments of the invention.

Referring now to the drawings, and in particular FIGS. 1-3, an example movable barrier system 100 includes a movable barrier 110 pivotably connected to a movable barrier pivot connection 115. The movable barrier system 100 also includes a linear actuator 120 with a first end 122 connected to the movable barrier 110 and a second end 124 connected to a linear actuator pivot connection 126. As shown in FIG. 2, the movable barrier 110 in this example comprises a swinging gate although a variety of other barriers may be operated using a linear actuator between a first and second position. In this example, the linear actuator 120 is configured to extend a connection arm 128, which moves the movable barrier 110 toward the first position. The linear actuator 120 is also configured to retract the connection arm 128, which moves the movable barrier 110 toward the second position. So configured, the retraction and extension of the connection arm 128 by the linear actuator 120 opens and closes the movable barrier 110.

A processor 130 is configured to variably control operation speed of the linear actuator 120 during operation between a first position of the movable barrier 110 and a second position of the movable barrier 110 as a function of position of the movable barrier pivot connection 115 relative to the linear actuator pivot connection 126. To control the linear actuator 120, the processor 130 is configured to receive information regarding the linear actuator 120 and the movement of the movable barrier 110 from the linear actuator 120 system. For example, the processor 130 may receive information regarding the position of the movable barrier 110 through limit switches, position detectors, or other means as known in the art for determining the position of the movable barrier and/or the position of the connection arm 128. The processor 130 controls the operation of the linear actuator 120 via a control of a voltage or current in the linear actuator that is known in the art.

A potentiometer 140 is operatively coupled to the processor 130 to input voltage representative of information regarding the position of the movable barrier pivot connection 115 relative to the linear actuator pivot connection 126. By another approach, at least one switch 150 is operatively coupled to the processor 130 to input information regarding the position of the movable barrier pivot connection 115 relative to the linear actuator pivot connection 126. As described herein, the potentiometer 140 and switch(es) 150 may input various types of information to the processor 130 to help the processor 130 control the speed of the linear actuator 120. An example of such information includes a ratio of the distance from the linear actuator pivot connection 126 to a fixed point 160 and the distance from the movable barrier pivot connection 115 to the fixed point 160. Another example of information that may be inputted by the potentiometer 140 and/or switches 150 includes manual speed settings to direct the processor 130 to operate the linear actuator 120 at certain speeds when moving the movable barrier 110 through certain portions of its travel. The potentiometer 140 and switches 150 and the means to connect the potentiometer 140 and switches 150 to the processor 130 to input information are known in the art. For example, the switches 150 may include a keyboard or keypad as known in the art.

The function used by the processor 130 to variably control operation speed of the linear actuator 120 may be one of various approaches. In one example approach, the function comprises a function of a ratio of a distance from the linear actuator pivot connection 126 to a fixed point 160 and a distance from the movable barrier pivot connection 115 to the fixed point 160. With reference to FIG. 1, the distance from the linear actuator pivot connection 126 is designated by the letter "A," and the distance from the movable barrier pivot connection 115 to the fixed point 160 is designated with the letter "B." When the ratio of A to B is approximately 1, in other words, when A is approximately equal to B, the speed of the movable barrier 110 as it moves from a first position (such as a closed position) to a second position (such as an open position) is approximately constant when the linear actuator 120 retracts or extends the connection arm 128 at a constant speed. When the ratio of A to B, however, deviates from 1, the movable barrier 110 will exhibit speed variances between the beginning and end of its travel between the first and second positions. The processor 130 may operate in combination with a memory 170 and look-up table 175 stored in the memory 170.

The processor 130 and memory 170 may be comprised of a plurality of physically distinct elements as is suggested by the illustration shown in FIG. 3. It is also possible, however, to view this illustration as comprising a logical view, in which case one or more of these elements can be enabled and realized via a shared platform. Those skilled in the art will recognize and appreciate that such a processor 130 can comprise a fixed-purpose hard-wired platform or can comprise a partially or wholly programmable platform. All of these architectural options are well known and understood in the art and require no further description here.

Figure 4:
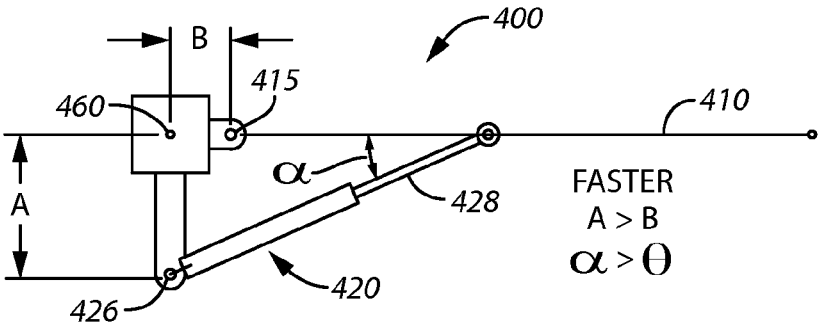
FIG. 4 comprises a top plan view of an example movable barrier system with a linear actuator pivot connection a greater distance from a fixed point as compared to a movable barrier connection as configured in accordance with various embodiments of the invention.
Figure 5:
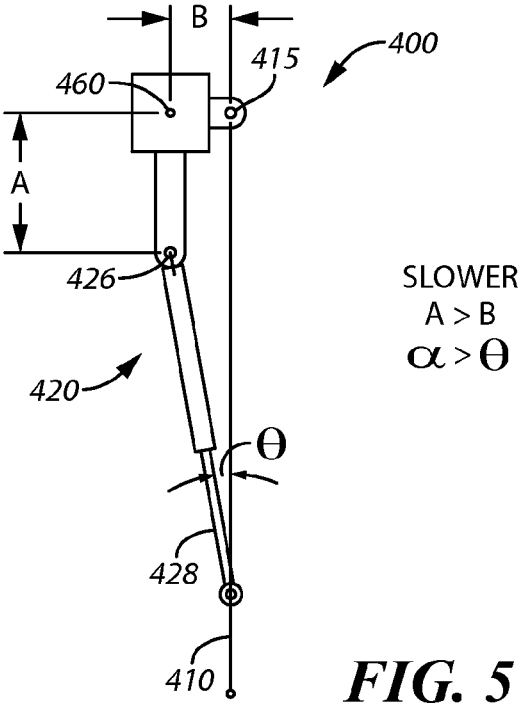
FIG. 5 comprises a top plan view of the movable barrier system of FIG. 4 with the movable barrier at a second, open position.

In one example, with reference to FIGS. 4 and 5, the movable barrier system 400 includes a linear actuator 420 with a linear actuator pivot connection 426 having a larger distance A away from a fixed point 460 as compared to the distance B between the movable barrier pivot connection 415 and the fixed point 460. When the movable barrier 410 is in the first position as shown in FIG. 4, the angle designated with the letter "α" between the movable barrier 410 and the connection arm 428 of the linear actuator 420 is larger than the angle designated with the letter "θ" between the movable barrier 410 and the linear actuator connection arm 428 when the removable barrier 410 is in a second or open position as shown in FIG. 5. In this configuration, assuming a constant speed for the linear actuator 420, the movable barrier 410 will move faster when closer to the first or closed position of FIG. 4 as compared to its speed near to the second or open position of FIG. 5.

By one approach, to adjust for this variable speed of the movable barrier 410 with constant linear actuator 420 speed, the processor 130 is configured to variably control operation speed of the linear actuator 420 according to a function of a ratio of A to B. In this approach, the function of the ratio includes operating the linear actuator 420 at a decreased speed when the movable barrier 410 is near the first position when the distance from the movable barrier pivot connection 415 to the fixed point 460 is less than the distance from the linear actuator pivot connection 426 to the fixed point 460, in other words the distance "A" is greater than the distance "B" as shown in FIGS. 4 and 5. For instance, the ratio is input by the potentiometer 140 or switches 150 to the processor 130, and the processor 130 calculates a speed correction profile (for example, variation of the linear actuator speed from a near constant speed between its travel endpoints and from typical acceleration and deceleration at the endpoints) for the linear actuator between the first position and the second position based upon the ratio of A to B. For example, the speed correction profile will increase correction of the linear actuator speeds near the travel endpoints where the ratio is increasingly distant from a 1:1 ratio. By one approach and with reference to FIG. 3, a memory 170 in connection with the processor 130 stores linear actuator speed values for operation between the first position and the second position. The linear actuator speed values are based at least in part on the function of position of the movable barrier pivot connection 415 relative to the linear actuator pivot connection 426. In this approach, the memory 170 stores the speed values based upon the processor's 130 computation of the speed profile based upon the ratio A to B.

By another approach, the function of position of the movable barrier pivot connection 426 relative to the linear actuator pivot connection 415 comprises a function of distance of the movable barrier 410 relative to at least one of the first position and the second position. In this approach, the processor 130 variably controls the operation speed of the linear actuator 420 to operate at an increased speed when the movable barrier 410 is closer to the second position when the distance from the movable barrier pivot connection 426 to a fixed point 460 is less than a distance from the linear actuator pivot connection 426 to the fixed point 460, in other words when A is greater than B as shown in FIGS. 4 and 5. In one such approach, the processor 130 controls the linear actuator speed based upon the movable barrier's 410 position in reliance on, for example, position sensing feedback either in the linear actuator 120 or on the movable barrier 410. The processor 130 in one example can access a look-up table 175 stored in the memory 170 to find the appropriate speed for the linear actuator 120 based upon the movable barrier's 410 position. In another approach, the processor 130 actively calculates the speed values based upon the ratio of A to B.

Another example approach to the function used by the processor 130 to variably control the operation speed of the linear actuator 120 includes operating via segments of speed change over distance between the first position and second position. In this approach, the speed change over distance between the first position and the second position depends at least in part on the function of position of the movable barrier pivot connection 126 relative to the linear actuator pivot connection 126. One such example segmented function shown in FIG. 6 may be applied to a situation as that of FIGS. 4 and 5 where the linear actuator pivot connection 426 is farther from the fixed position 460 as compared to the movable barrier pivot connection 415, in other words, where A is greater than B. The "Y" or vertical axis of the graph represents the linear actuator speed and the "X" of horizontal axis of the graph represents the movable barrier position between the closed or first position and the open or second position. To account for a faster movable barrier relative speed when closer to the closed or first position when the linear actuator moves at a constant speed, the linear actuator speed of FIG. 6 has a less sloped increase when closer to the first or closed position at segment 610 to effectively reduce movable barrier speed near the closed position. The linear actuator speed of the second segment 620 continues to increase but not at as large of a rate when the movable barrier 410 is further away from the closed or first position. The linear actuator 420 continues to move at a relatively high speed up to a relatively close distance away from the open or second position. Moving at this quicker speed helps compensate for the slower relative speed of the movable barrier 410 when approaching the open or second position when the distance A is larger than the distance B. The linear actuator speed drops off quickly at segment 630 as the linear actuator 420 moves the movable barrier 410 to stop at the second or open position.

The potentiometer 140 operatively coupled to the processor 130 can input the function of position of the movable barrier pivot connection 415 relative to the linear actuator pivot connection 426. By another approach, the at least one switch 150 is operatively coupled to the processor 130 to input the function of position of the movable barrier pivot connection 115 relative to the linear actuator pivot connection 126. So configured, the linear speed function of FIG. 6 may be inputted into the processor 130 and memory 170 via the potentiometer 140 or switches 150 or information that allows this function to be determined by the processor 130 may be inputted by the potentiometer 140 and/or switches 150.

Figure 7:
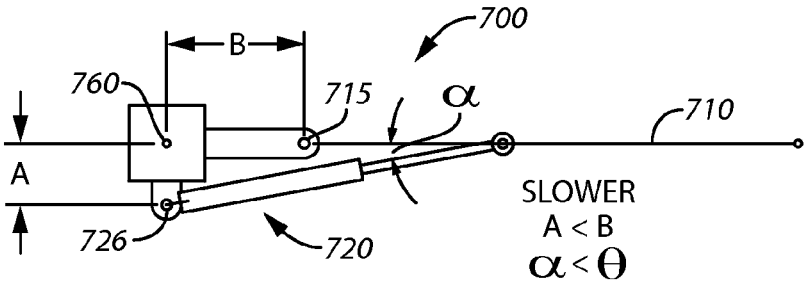
FIG. 7 comprises a top plan view of an example movable barrier system with a movable barrier pivot connection a greater distance from a fixed point as compared to a linear actuator pivot connection as configured in accordance with various embodiments of the invention.
Figure 8:
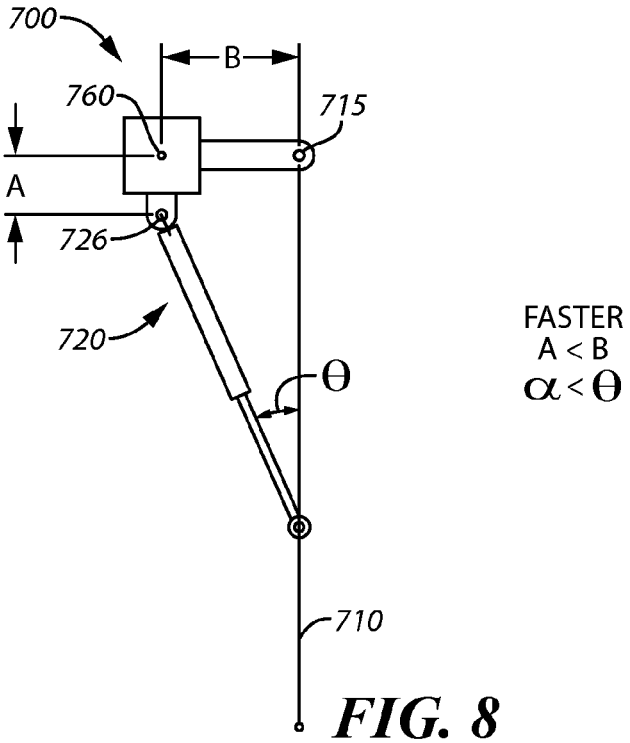
FIG. 8 comprises a top plan view of the movable barrier system of FIG. 7 with the movable barrier in a second, open position.

With reference to FIGS. 7 and 8, a movable barrier system 700 includes a movable barrier 710 with a movable barrier pivot connection 715 and a linear actuator 720 with a linear actuator pivot connection 726. In this example, the movable barrier pivot connection 715 has a larger distance B from a fixed point 760 as compared to the linear actuator movable pivot connection 726 distance A to the fixed point 760. The angle $\alpha$ between the movable barrier 710 and the connection arm of the linear actuator 720 in a closed or first position of FIG. 7 is smaller than the angle $\theta$ when the movable barrier 710 is in the open or second position shown in FIG. 8. In this configuration assuming a constant speed for the linear actuator 720, the movable barrier 710 moves at a relatively slower pace when close to the first or closed position as compared to the movable barrier speed when moving near the second or open position of FIG. 8. For a movable barrier system 700 of the configuration of FIGS. 7 and 8, in one approach, the processor 130 controls the operation speed of the linear actuator 720 according to a function of the ratio of A to B where the function includes operating the linear actuator 720 at an increased speed when the movable barrier 710 is near the first position when the distance from the movable barrier pivot connection 715 to the fixed point 760 is greater than the distance from the linear actuator pivot connection 726 to the fixed point 760. As with the example system of FIGS. 4 and 5, the processor 130 may take the ratio of the distance A to distance B to operate the linear actuator 720 at relatively faster speed when the movable barrier 710 is close to the closed or first position of FIG. 4 and at a relatively slower speed when the movable barrier 710 is close to the open or second position of FIG. 8.

By another approach, the function of position of the movable barrier pivot connection 715 relative to the linear actuator pivot connection 726 comprises a function of the distance of the movable barrier 710 relative to at least one of the first position and the second position. The function includes operating the linear actuator 720 at an increased speed when the movable barrier 710 is closer to the first position than the second position when the distance and the movable barrier pivot connection 715 to a fixed point 760 is greater than the distance from the linear actuator pivot connection 726 to the fixed point 760. Here, the processor 130 controls the linear actuator speed based upon the movable barrier position relative to the first and second position to accommodate for the relatively slower or faster speed of the movable barrier through the first position and second position, respectively. In this example the processor 130 can work with the memory 170 to determine the linear actuator speed with respect to the movable barrier 710 position.

Figure 9:
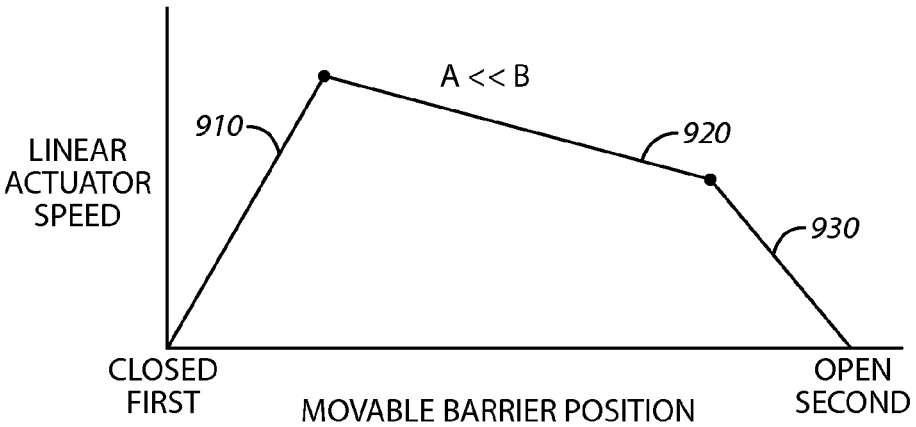
FIG. 9 comprises a graph of an example piece-wise linear function of linear actuator speed over movable barrier position between a first position and a second position as configured in accordance with various embodiments of the invention.

By yet another approach, the processor 130 may variably control the operation speed of the linear actuator 720 according to a piece-wise function comprising segments of speed change over distance between the first position and the second position. The speed change over distance between the first position and the second position depends at least in part on the function of the position of the movable barrier pivot connection 715 relative to the linear actuator pivot connection 726. An example piece-wise function of the linear actuator speed versus the movable barrier position between the closed, first position and the open, second position for the movable barrier system 700 of FIGS. 7 and 8 is shown in FIG. 9. As discussed above, the potentiometer 140 and switches 150 can be operatively coupled to the processor 130 to input this function or information that allows this function to be determined by the processor 130. Because the movable barrier 710 of FIGS. 7 and 8 moves relatively slower near the closed or first position of FIG. 7, the linear actuator speed as shown in FIG. 9 is quickly increased to its quickest speed along the first segment 910 to compensate for that slower relative movement. As the movable barrier 710 moves towards the second or open position, the movable barrier 710 will move relatively faster assuming constant speed for the linear actuator 720. Therefore, to compensate for this speed increase, the next segment 920 of the linear actuator speed is gradually decreased so that the user experiences a more generally constant movement of the movable barrier 710 during operation. As the movable barrier 710 approaches the open or second position, the linear actuator speed at the third segment 930 is decelerated a little sooner to compensate for the increasing relative speed of the movable barrier under constant linear actuator speed conditions.

In another example, the movable barrier system 100 includes a processor 130 configured to variably control operation speed of the linear actuator 120 during operation between a first position of the movable barrier 110 and a second position of the movable barrier 110 according to a user input. The user input increases actuator speed at one of the first position and the second position with respect to the actuator speed at an operative movable barrier position. The movable barrier system of this approach may include a potentiometer 140 or at least one switch 150 through which the user input is received. Because the movable barrier typically will have a relatively faster speed at one of either the first position or second position as described above, the processor 130 increases actuator speed at one of the first position and the second position with respect to actuator speed at the opposite movable barrier position by decreasing the actuator speed at the opposite movable barrier position to account for movable barrier speed variation. The processor 130 can vary the speed in a number of ways. In one example, the actuator speed is varied approximately linearly during movement between the first position and the second position. In another example, the speed is varied according to a mathematical function during movement between the first position and the second position. For instance, the mathematical function may calculate a speed correction profile for the linear actuator between the first position and the second position based upon the ratio of A to B. For example, the speed correction profile will increase correction of the linear actuator speeds near the travel endpoints where the ratio is increasingly distant from a 1:1 ratio. By still another example, the speed is varied according to a piece-wise linear function during movements between the first position and the second position. In yet another example, the speed is varied according to a look-up table 175 stored in the memory 170 based on position of the barrier between the first position and the second position and the relative positioning of the movable barrier pivot connection 115 and the linear actuator pivot connection 126. In this example, the look-up table 175 provides the processor 130 with specific linear actuator speeds based upon stored positions of the movable barrier along its path of travel.

So configured, the linear actuator speed may be actively controlled to account for speed variances that arise based upon the physical configuration of a given movable barrier system. The user of such a movable barrier system using a linear actuator may observe a more relatively constant motion or speed for the movable barrier as compared to systems where the linear actuator is operated at a constant speed.

Figure 10:
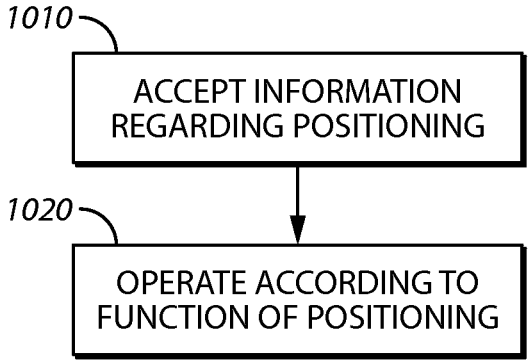
FIG. 10 comprises a flow diagram of an example method of operating a movable barrier system in accordance with various embodiments of the invention.

With reference to FIG. 10 a method of operating a movable barrier system will be described. In one approach, the method includes at step 1010 accepting information regarding relative positioning of the linear actuator pivot connection 126 and the movable barrier pivot connection 115. The step 1010 of accepting input information may include accepting input information from the potentiometer 140 regarding relative positioning of the linear actuator pivot connection 126 and the movable barrier pivot connection 115. By another approach, that step 1010 may include accepting input information from at least one switch 150 regarding relative positioning of the linear actuator pivot connection 126 and the movable barrier pivot connection 115.

Figure 6:
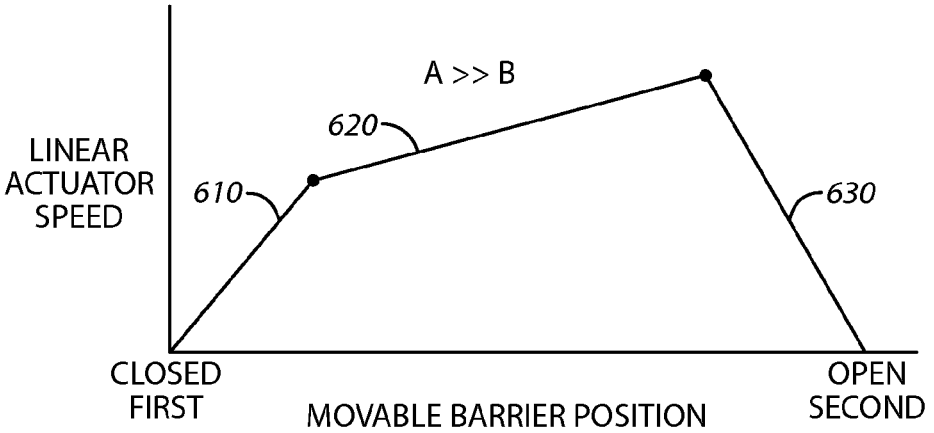
FIG. 6 comprises a graph showing an example piece-wise linear function of speed over movable barrier position between an open position and a closed position, as configured in accordance with various embodiments of the invention.

At step 1020 the method includes operating the linear actuator 120 to move between the first position and the second position according to a function of the relative positioning of the linear actuator pivot connection 126 and the movable barrier pivot connection 115. The step 1020 of operating the linear actuator 120 to move according to a function of the relative positioning of the linear actuator pivot connection and the movable barrier pivot connection can be accomplished in a number of ways. In one approach, the step includes operating the linear actuator 120 according to a function of the ratio of a distance from the linear actuator pivot connection 126 to a fixed point 160 and a distance from the movable barrier pivot connection 115 to the fixed point 160. In other words, the step is executed according to a function of the ratio of the relative distances A and B as described above. By another approach, the linear actuator 120 may be operated at an increased speed when the movable barrier 110 is near the first position when the distance from the movable barrier pivot connection 115 to the fixed point 160 is greater than the distance from the linear actuator pivot connection 126 to the fixed point 160 or, for example, when the distance B is larger than the distance A in FIG. 1. In another approach, the linear actuator 120 is operated at a decreased speed when the movable barrier 110 is near the first position when the distance from the movable barrier pivot connection 115 to the fixed point 160 is less than the distance from the linear actuator pivot connection 126 to the fixed point 160. In this approach, the distance A is larger than distance B of FIG. 1. In yet another approach to operating according to the function of positioning in step 1020, the linear actuator 120 may be operated according to a piece-wise function comprising a plurality of segments comprising speed change over distance between the first position and the second position. In this approach, the speed change over distance between the first position and the second position depends at least in part on the relative positioning of the linear actuator pivot connection 126 and the movable barrier pivot connection 115. The graphs of FIGS. 6 and 9 are examples of such piece-wise function comprising a plurality of segments.

In another example, a movable barrier system has a movable barrier 110 pivotably connected to a movable barrier pivot connection 115 and a linear actuator 120 with a first end 122 pivotably connected to the movable barrier 110 and a second end 124 pivotably connected to a linear actuator pivot connection 126 such that the operation of the linear actuator 120 moves the movable barrier 110 between a first position and a second position. The operation of the linear actuator 120 at a substantially constant speed results in movement of the movable barrier 110 at different speed at the first position and the second position. The movable barrier system is operated in this example according to a method including operating the linear actuator 120 at an increased speed over a first distance of operation of the movable barrier 110 between the first position and the second position. In this example, the first distance comprises a range of movement where the movable barrier 110 operates at a reduced speed relative to a second distance of operation of the movable barrier 110 between the first position and the second position when the linear actuator 120 operates at a substantially constant speed between the first distance and the second distance. In this example, the linear actuator is operated at varying speeds to account for the movable barrier speed variations that occur when the linear actuator 120 is operated in a constant speed in certain physical system configurations. By one approach, the first distance of operation of the movable barrier 110 between the first position and the second position is determined at least in part according to a function of a ratio of a distance from the linear actuator pivot connection 126 to a fixed point 160 and a distance from the movable barrier pivot connection 115 to the fixed point 160. In other words, the ratio of A to B as described above with respect to FIG. 1 can dictate the first distance over which the movable barrier will operate at a reduced speed relative to the second distance.

So configured, a movable barrier system having a processor can be configured to operate a linear actuator in a number of different ways to account for varying movable barrier speed caused by the physical configuration of a linear actuator movable barrier system. For instance, the ratio of distances that relate to the varying movable barrier speed when operating a linear actuator at a constant speed can be used by the processor to automatically create a modified speed profile to adjust for the varying movable barrier speed. In another approach, the processor receives input from a user or from a system installer that directs the processor to move the movable barrier at an increased speed over a certain portion of its travel between first and second positions. By still another approach, specific functions based upon resistance of the movable barrier from one or the other end of travel positions for the movable barrier can be inputted to or accessed by the processor to help control the linear actuator. Each of these approaches improve the user experience of such a movable barrier so as to not be frustrated by a slow moving barrier or a barrier having an inconsistent speed profile.

Those skilled in the art will recognize that a wide variety of modifications, alterations, and combinations can be made with respect to the above described embodiment, without departing from the scope of the invention. For instance, although the above examples are described with reference a particular ratio of distances and characterization of the barrier positions as open or closed, the ratio and characterizations may be reversed for a particular application. Also, other barrier types than a swinging gate may be operated using a linear actuator and according to the teachings herein. Such modifications, alterations, and combinations are to be viewed as being without the ambit of the inventive concept.

What is claimed is:

1. A movable barrier system comprising:

a movable barrier pivotally connected to a movable barrier pivot connection;

a linear actuator with a first end pivotally connected to the movable barrier and a second end pivotally connected to a linear actuator pivot connection;

a processor configured to variably control an operation speed of the linear actuator during operation thereof between a first position of the movable barrier and a second position of the movable barrier based on a position of the movable barrier pivot connection relative to a position of the linear actuator pivot connection;

an input device operatively coupled to the processor to input information regarding the position of the movable barrier pivot connection relative to the position of the linear actuator pivot connection;

wherein the processor is configured to variably control the operation speed of the linear actuator in response to a ratio of a distance from the linear actuator pivot connection to a fixed point and a distance from the movable barrier pivot connection to the fixed point as determined from the information received from the input device.

2. The movable barrier system of claim 1 wherein the movable barrier comprises a swinging gate.

3. The movable barrier system of claim 1 wherein the input device comprises a potentiometer operatively coupled to the processor to input the information regarding the position of the movable barrier pivot connection relative to the position of the linear actuator pivot connection.

4. The movable barrier system of claim 1 wherein the input device comprises at least one switch operatively coupled to the processor to input the information regarding the position of the movable barrier pivot connection relative to the position of the linear actuator pivot connection.

5. The movable barrier system of claim 1 wherein the linear actuator is configured to extend a connection arm, which moves the movable barrier toward the first position, the linear actuator configured to retract the connection arm, which moves the movable barrier toward the second position.

6. The movable barrier system of claim 1 wherein the input device comprises a potentiometer configured to input voltage to the processor to determine the ratio of the distance from the linear actuator pivot connection to the fixed point and the distance from the movable barrier pivot connection to the fixed point.

7. The movable barrier system of claim 1 wherein the input device comprises at least one switch operatively coupled to the processor to determine the ratio of the distance from the linear actuator pivot connection to the fixed point and the distance from the movable barrier pivot connection to the fixed point.

8. The movable barrier system of claim 1 wherein the processor is configured to variably control the operation speed of the linear actuator via a function of the ratio when the distance from the movable barrier pivot connection to the fixed point is greater than the distance from the linear actuator pivot connection to the fixed point.

9. The movable barrier system of claim 1 wherein the processor is configured to variably control the operation speed of the linear actuator via a function of the ratio when the distance from the movable barrier pivot connection to the fixed point is less than the distance from the linear actuator pivot connection to the fixed point.

10. The movable barrier system of claim 1 wherein the processor is configured to variably control the operation speed of the linear actuator via a function of the ratio when the movable barrier is closer to the first position than the second position when the distance from the movable barrier pivot connection to the fixed point is greater than the distance from the linear actuator pivot connection to the fixed point.

11. The movable barrier system of claim 1 wherein the processor is configured to variably control the operation speed of the linear actuator via a function of the ratio when the movable barrier is closer to the second position than the first position when the distance from the movable barrier pivot connection to the fixed point is less than the distance from the linear actuator pivot connection to the fixed point.

12. The movable barrier system of claim 1 wherein the processor is configured to variably control the operation speed of the linear actuator via a piecewise function of a change of speed of the barrier as the barrier moves between the first position and the second position, wherein the change of the speed of the barrier depends at least in part on the position of the movable barrier pivot connection relative to the position of the linear actuator pivot connection.

13. The movable barrier system of claim 12 wherein the input device comprises at least one switch operatively coupled to the processor to determine the position of the movable barrier pivot connection relative to the position of the linear actuator pivot connection.

14. The movable barrier system of claim 12 wherein the input device comprises a potentiometer configured to input voltage to the processor to determine the position of the movable barrier pivot connection relative to the position of the linear actuator pivot connection.

15. The movable barrier system of claim 1 further comprising a memory in communication with the processor, the memory storing linear actuator speed values, wherein the linear actuator speed values are based at least in part on the position of the movable barrier pivot connection relative to the position of the linear actuator pivot connection.

16. The movable barrier system of claim 15 wherein the input device comprises at least one switch operatively coupled to the processor to determine the position of the movable barrier pivot connection relative to the position of the linear actuator pivot connection.

17. The movable barrier system of claim 15 wherein the input device comprises a potentiometer configured to input voltage to the processor to determine the position of the movable barrier pivot connection relative to the position of the linear actuator pivot connection.

18. The movable barrier system of claim 1 wherein the first position is a closed position and the second position is an open position.

19. The movable barrier system of claim 1 wherein the first position is a first end of travel position and the second position is a second end of travel position.

* * * * *